US005306151A

United States Patent [19]

Rauch

[11] Patent Number: 5,306,151

[45] Date of Patent: Apr. 26, 1994

[54] TOOTHBRUSH

[76] Inventor: Samuel Rauch, 40 Spruce St., Cedarhurst, N.Y. 11516

[21] Appl. No.: 963,029

[22] Filed: Oct. 19, 1992

Related U.S. Application Data

[62] Division of Ser. No. 568,476, Aug. 16, 1990, abandoned.

[51] Int. Cl.[5] ..... A61C 15/00; A46B 9/04

[52] U.S. Cl. ..... 433/216; 15/167.1

[58] Field of Search ..... 433/216; 15/167.1, 167.2, 15/143 R; D4/104-113, 138

[56] References Cited

U.S. PATENT DOCUMENTS

| | | | |
|---|---|---|---|
| Re. 22,938 | 11/1947 | Kisky | 15/143 R |
| D. 110,185 | 6/1938 | Lukenbill | 15/143 R |
| D. 110,186 | 6/1938 | Lukenbill | 15/143 R |
| D. 140,438 | 2/1945 | Cohen | 15/143 R |
| D. 163,707 | 6/1951 | Pifer | 15/167.1 |
| D. 257,192 | 10/1980 | Moses | 15/143 R |
| 1,984,787 | 12/1934 | Elliott . | |
| 2,263,885 | 11/1941 | McGauley . | |
| 2,304,319 | 12/1942 | Saltzman | 15/143 R |
| 2,690,579 | 10/1954 | Backstrom . | |
| 2,823,404 | 2/1958 | Hyman | 15/167.1 |
| 2,978,724 | 4/1961 | Gracian | 15/167.1 |
| 4,351,080 | 9/1982 | Grossman . | |
| 4,356,585 | 11/1982 | Protell et al. | 15/167.1 |
| 4,519,109 | 5/1985 | Raymond . | |
| 4,542,552 | 9/1985 | d'Argembeau . | |
| 4,672,706 | 6/1987 | Hill . | |

FOREIGN PATENT DOCUMENTS

| | | | |
|---|---|---|---|
| 741585 | 11/1943 | Fed. Rep. of Germany | 15/143 R |
| 85401 | 2/1936 | Sweden | 15/143 R |
| 15598 | of 1903 | United Kingdom | 15/143 R |
| 379150 | 8/1932 | United Kingdom | 15/167.1 |

*Primary Examiner*—John G. Weiss
*Assistant Examiner*—Nicholas D. Lucchesi
*Attorney, Agent, or Firm*—Ladas & Parry

[57] ABSTRACT

A toothbrush has a brush head of bristles joined to a gripping portion which when grasped and used by a user in a natural, common and ordinary manner, results in the brush head being positioned automatically at a 45° angle with the long axis of the teeth; the preferred tooth cleaning position of the Dr. Skillman and Dr. Bass toothbrushing method. The handle is a symmetrical four-sided column having a cross-section which can be circumscribed by a square with one diagonal parallel to the bristles of the brush head.

3 Claims, 4 Drawing Sheets

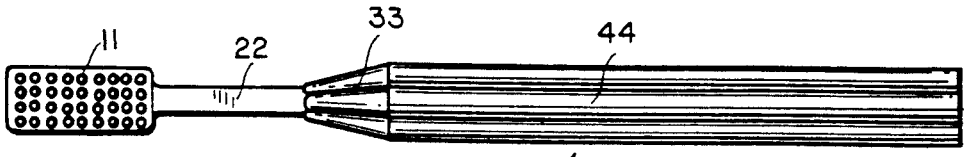
FIG. 2
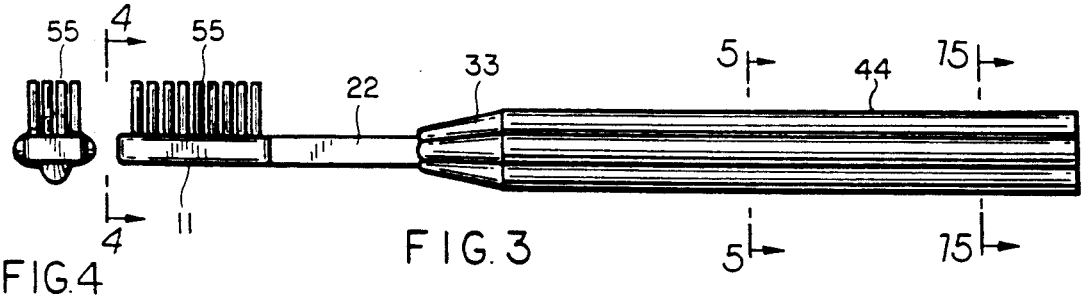
FIG. 4
FIG. 3
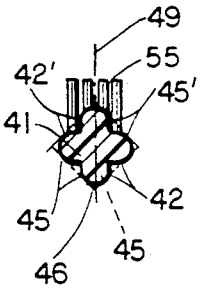
FIG. 5
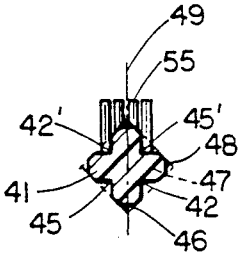
FIG. 6
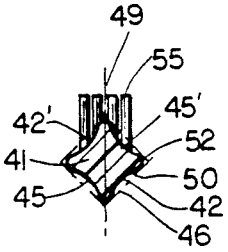
FIG. 7
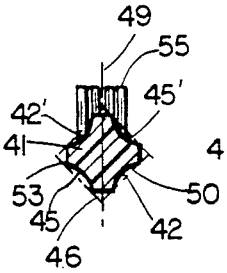
FIG. 8
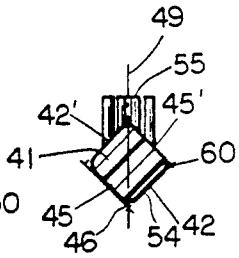
FIG. 9
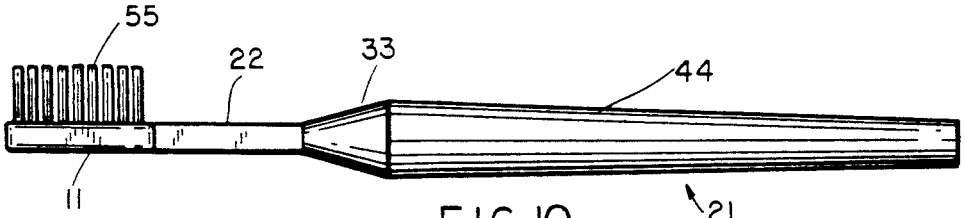
FIG. 10
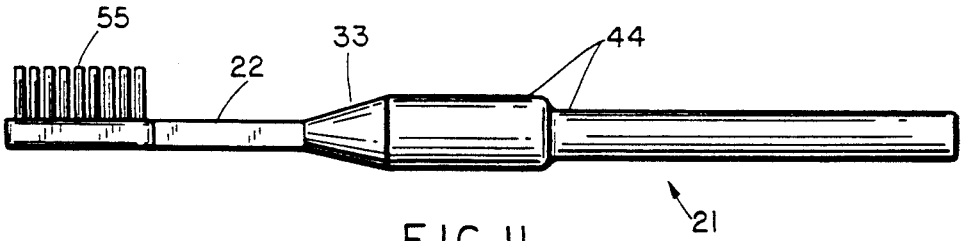
FIG. 11

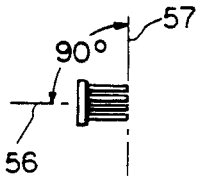
FIG. 17B
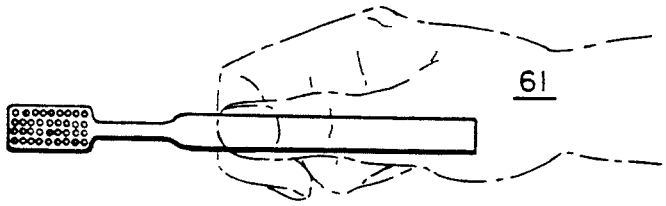
FIG. 17A
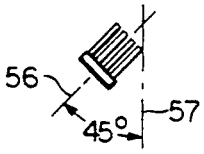
FIG. 18B
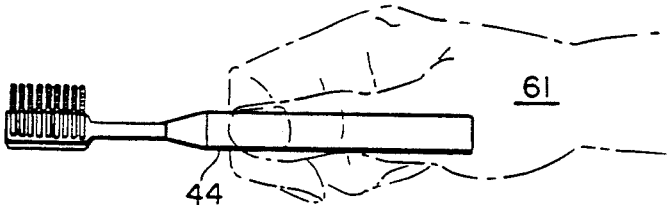
FIG. 18B
FIG. 19B
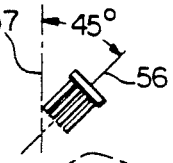
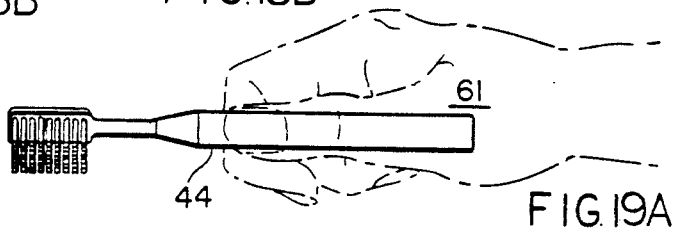
FIG. 19A
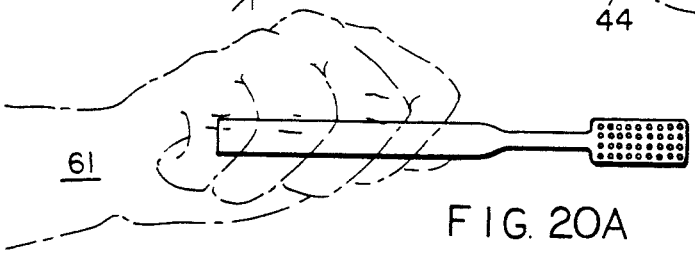
FIG. 20A
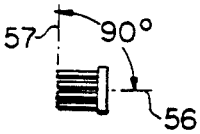
FIG. 20B
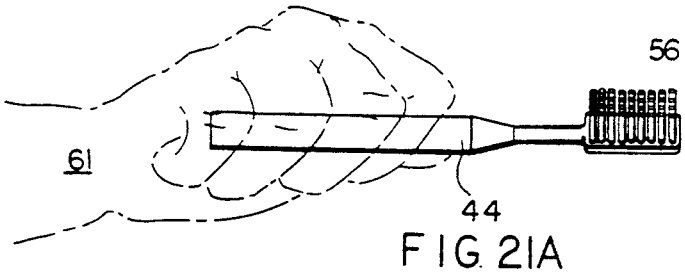
FIG. 21A
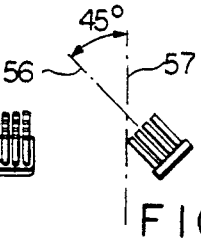
FIG. 21B
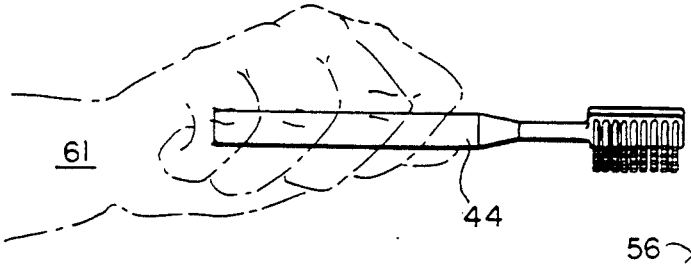
FIG. 22A
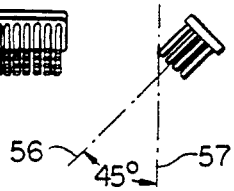
FIG. 22B

TOOTHBRUSH

This is a divisional of copending application(s) Ser. No. 07/568,476 filed on Aug. 16, 1990, now abandoned.

BACKGROUND OF THE INVENTION

The present invention relates to a toothbrush, more particularly, the invention relates to a toothbrush having a handle specifically designed in cross-section and in geometrical relationship to the brush head in a manner whereby when the toothbrush is used in a natural common and ordinary manner the bristles of the brush head will be automatically angled 45° into the long axis of the teeth when used in all areas of the user's mouth.

Although bacterial plaque has been recognized as the prime cause of tooth decay and periodontal disease which results in tooth loss, fluorides put in drinking water, toothpastes and mouthwashes have made tooth enamel resistant to said bacterial plaque with a very significant reduction of tooth decay. Tooth loss today in most advanced countries, is caused by unremoved plaque in the inter-dental areas and gum margins hardening into tartar. This results in subsequent gum irritation, recession and bacterial infection of the gums, exposure of the decay-prone dentine, invasion of bacteria and degeneration of bone resulting in loosening of the teeth. In order to make a significant contribution in reducing tooth loss, a modern, improved toothbrush must address these issues. It must remove plaque in and around inter-dental areas, gum margins and under the sulcus. It must gently massage the gums at the interface of the tooth and gum, thus contributing to the general health of the gums in essentially the same way that exercise contributes to the general health of living tissue by drawing blood into the exercised area.

The importance of caring for gums and teeth as a system for proper oral health care was first taught by U.S. Pat. No. 2,845,649 wherein soft toothbrush bristles and massages were recommended as best for gingival tissue. Many toothbrushing methods have been developed by dental professionals to achieve this end. The most popular current method is the Bass, or Stillman technique. A current textbook describing this method is "Glickman's Clinical Periodontology," Ferman A. Carranza, Jr., Dr. Odont, Fifth Edition, 1979, pages 729 to 738 published by W. B. Saunders Co., Philadelphia. The Bass Stillman toothbrushing method calls for short horizontal brush strokes and angling the bristles 45° into the gumline. This method and others taught by dental health professionals, if applied faithfully by the average person using any of many conventional toothbrushes commercially available will result in reasonably clean, plaque-free teeth in the critical areas previously described. Recent surveys have shown that the average person does not use a professionally developed and recognized toothbrushing method, or take the time necessary to brush his or her teeth properly. If taught a correct method, the person soon forgets or revises the method and reverts to old, incorrect toothbrushing habits. The average person brushes their teeth in a casual manner using brush strokes that are basically, but not entirely, horizontal, while brushing for a short period of time compared to what is required for the Dr. Bass or a similar professional toothbrushing method. Conventional flat-handled toothbrushes used in this casual manner do not provide proper oral health care.

The challenge is to provide a toothbrush that compensates for this fact, or teaches the proper technique.

Pugh, in U.S. Pat. No. 4,081,876, expanded and used the soft bristle concept and taught the value of inclined bristles or filaments flexing relative to the upright as brushing force is applied to the toothbrush handle, so that plaque is removed more effectively by the flexing action.

Rauch, in U.S. Pat. No. 4,776,054, shows a brush head which automatically compensates for a user's lack of proper method, by providing increased bristle action in the sulcus, gum and gumline area.

Other patents disclose that the relationship of the brush head and brush handle and the shape of the brush handle can help position the bristles in relation to the teeth and gingival tissue in a preferred manner. McGauley, U.S. Pat. No. 2,263,885 and Grossman, U.S. Pat. No. 4,351,080 are examples of this concept.

Raymond, in U.S. Pat. No. 4,519,109, has expanded the foregoing concept by calling for specific positioning of the thumb and index finger on a marked or colored portion of part of a brush handle to position the brush head in a choregraphed manner, so that the bristles are positioned in a preferred angular position within the mouth.

In order to be effective, a modern, improved toothbrush must function in an optimum manner in the interdental, gingival margin and sulcus area.

The principal object of the invention is to provide a toothbrush which greatly reduces and prevents tooth decay, tooth loss and gum diseases.

An object of the invention is to provide a toothbrush which is usable with facility and ease and which, when used properly, will greatly reduce and prevent tooth decay, tooth loss and gum diseases.

Another object of the invention is to provide a toothbrush of simple structure, which greatly reduces and removes bacterial plaque, when used in a simple prescribed manner, thereby greatly reducing and eliminating tooth decay and gum diseases.

Still another object of the invention is to provide a toothbrush which may be used in a casual manner to clean the teeth and massage the gums in a superior manner.

Yet another object of the invention is to provide a toothbrush which may be used in a casual manner to clean and massage the inter-dental, gum margin and sulcus areas in a superior manner.

Another object of the invention is to provide a toothbrush which functions with the highest efficiency, effectiveness and reliability possible in removing plaque in relation to the time and effort expended by the user in brushing the teeth.

Still another object of the invention is to provide a toothbrush which, in use, positions the brush head bristles in the user's mouth automatically, without the user's conscious effort, in the position prescribed in the Dr. Bass and Dr. Skillman toothbrushing method.

Yet another object of the invention is to provide a toothbrush which, in use, positions the bristles of the brush head in the user's mouth automatically, without the user's conscious effort, at a 45° incline with the long axis of the teeth in all areas of the user's mouth.

Another object of the invention is to provide a toothbrush which, in use, positions the brush head bristles in the user's mouth, automatically, without the user's conscious effort, at a 45° incline with the sulcus in all areas of the user's mouth to facilitate the entry of the bristles under the sulcus to clean and massage this area.

Still another object of the invention is to provide a toothbrush having a handle with two pairs of detented positions, running the length of the gripping portion of the handle, which permits the automatic positioning of the brush head bristles into the sulcus area at a 45° angle in all areas of the user's mouth.

Yet, another object of the invention is to provide a toothbrush having a handle with rounded corners extending for the length of the gripping portion of the handle, which corners cause the user's hand to slip, when wet, into the comfortable detented handle positions thereby permitting the automatic positioning of the brush head bristles into the sulcus area at a 45° angle in all areas of the user's mouth.

BRIEF SUMMARY OF THE INVENTION

In accordance with the invention, a toothbrush having a substantially longitudinally aligned handle having spaced opposite ends comprises a brush head at one end of the handle having a plurality of bristles extending therefrom. A gripping portion at the opposite end of the handle has a cross-section that can be circumscribed by a square, which square has a first diagonal substantially parallel to the bristles of the brush head, a second diagonal intersecting the first diagonal and substantially perpendicular to the bristles, and four longitudinal sides forming two detente gripping positions for a hand of a user. Each of the detente gripping positions consists of a pair of spaced opposite longitudinal sides. The detente gripping positions are substantially perpendicular to each other.

The bristles of the brush head extend substantially parallel to each other.

Each of the four longitudinal sides has a substantially hollow or depressed surface and the sides are joined to each other at substantially planar joining areas.

Each of the four longitudinal sides has a substantially depressed surface and the sides are joined to each other at substantially curved joining areas.

Each of the four longitudinal sides is substantially planar and the sides are joined to each other at substantially curved joining areas.

The handle tapers down from an intermediate area to the opposite end.

The handle tapers down in stepped configuration in a modification.

The gripping portion has an exterior surface formed by four equal diameter elongated substantially cylindrical members joined to each other.

Each of the four longitudinal sides is 0.375 to 0.625 inch in width.

The gripping portion has an exterior surface formed by four elongated members joined to each other, each of the members being substantially octagonal in cross-section.

The bristles of the brush head extend substantially parallel to each other in spaced substantially parallel rows and the gripping portion is arcuate in planes through the rows of bristles.

A base portion at the free edge of the opposite end supports the toothbrush in an upright position on a substantially horizontal surface.

The base portion has a greater cross-sectional area than the cross-sectional area of the gripping portion and is substantially coaxially aligned with the gripping portion.

In accordance with the invention, a toothbrush for efficient cleaning of the teeth, the area under the sulcus and between teeth and for massage and stimulation of the gums, has a substantially longitudinally aligned handle and brush head at one end of the handle. The brush head may be of known type, as shown in U.S. Pat. No. 2,845,649, where all the bristles are essentially perpendicular to a planar bristle holding part of the brush head, or of uncommon type as shown in Rauch, U.S. Pat. No. 4,081,876 where some or all of the bristles are angled in relation to the planar part of the brush head. The uncommon brush head may have a mean, average or preponderant bristle direction that could be represented by a vector relative to the planar bristle holding part of said brush head. Any suitable brush head may be used in the present invention, either known or otherwise.

The handle of the toothbrush of the invention comprises three or four parts. A relatively thin forward portion of rectangular, circular, elliptical, or other similar cross-section extends from the brush head, which brush head is placed in the user's mouth during most of the toothbrushing procedure. A substantial gripping portion permits a user to grip the toothbrush in a firm, detented manner between the thumb and the curled remainder of the fingers on his or her hand, with the prime opposition to the thumb being the index and middle finger of the user's hand located directly under the thumb. This position is the natural untaught, comfortable gripping position which the vast majority of toothbrush users would assume during the toothbrushing procedure. A relatively short transition portion joins the thin forward portion to the substantial gripping portion and has a shape that smoothly transitions into each portion joined by it.

The toothbrush is shown with the longitudinal axis of the brush head and the brush handle being one and the same. The toothbrush of the invention could have the longitudinal axes of the brush head, forward portion of the handle and gripping portion of the handle, inclined or parallel to each other. The forward portion and/or the gripping portion could be curved or substantially arcuate in configuration.

The cross-section of the gripping portion of the handle has opposed surfaces contoured to provide a detente for the arced configuration of the gripping fingers of the hand. The cross-section of the gripping portion of the handle is circumscribed by a square. The cross-section of the gripping portion of the handle has rounded, radiused corners within the square circumscribed section.

The geometrical relationship of the gripping portion of the handle to the brush head is such that one diagonal of the square of the circumscribed section is parallel to the bristles and the other diagonal of said square is perpendicular to said bristles.

When a person uses the toothbrush of the invention in a common, ordinary and untaught manner, the brush head bristles will be positioned automatically to a detented 45° into the long axis of the teeth. This is the prescribed brush head position in the Dr. Skillman and Dr. Bass toothbrushing method. In the contrary, a common toothbrush, with a planar handle extending from a planar brush head, requires a user to rotate the wrist in a learned manner to achieve the prescribed 45° position into the gumline and long axis of the teeth.

BRIEF DESCRIPTION OF THE DRAWINGS

In order that the invention may be readily carried into effect, it will now be described with reference to the accompanying drawings, wherein;

FIG. 2 is a top view of the first embodiment of the toothbrush of FIG. 1;

FIG. 3 is a side view of the first embodiment of the toothbrush of FIG. 1;

FIG. 4 is an end view, taken along the lines IV—IV, of FIG. 3;

FIG. 5 is a cross-sectional view, taken along the lines V—V, of FIG. 3 and shows the orientation of the bristles of the brush head to the cross-section;

FIG. 6 is a cross-sectional view of the gripping portion of the handle and its orientation to the bristles of the brush head of a second embodiment of the toothbrush of the invention;

FIG. 7 is a cross-sectional view of the of the gripping portion of the handle and its orientation to the bristles of the brush head of a third embodiment of the toothbrush of the invention;

FIG. 8 is a cross-sectional view of the gripping portion of the handle and its orientation to the bristles of the brush head of a fourth embodiment of the toothbrush of the invention;

FIG. 9 is a cross-sectional view of the gripping portion of the handle and its orientation to the bristles of the brush head of a fifth embodiment of the toothbrush of the invention;

FIG. 10 is a side view of a first modification of the first, second, third, fourth and fifth embodiments of the toothbrush of the invention;

FIG. 11 is a side view of a second modification of the first, second, third, fourth and fifth embodiments of the toothbrush of the invention;

FIG. 17A shows the position of a flat-handled toothbrush of known type held in the right hand of a user about to insert it in his mouth to brush the teeth on the left side of his mouth;

FIG. 17B shows the angular relationship of the bristles of the toothbrush of FIG. 17A relative to the long axis of the teeth;

FIG. 18A shows the position of the toothbrush of the invention, held in the right hand of a user about to insert it in his mouth to brush the exterior surface of his left upper teeth;

FIG. 18B shows the angular relationship of the bristles of the toothbrush of FIG. 18A relative to the long axis of the teeth;

FIG. 19A shows the position of the toothbrush of the invention, held in the right hand of a user about to insert it in his mouth to brush the exterior surface of his left lower teeth;

FIG. 19B shows the angular relationship of the bristles of the toothbrush of FIG. 19A relative to the long axis of the teeth;

FIG. 20A shows the position of a flat-handled toothbrush of known type held in the right hand of a user about to insert it in his mouth to brush the teeth on the right side of his mouth;

FIG. 20B shows the angular relationship of the bristles of the toothbrush of FIG. 20A relative to the long axis of the teeth;

FIG. 21A shows the position of the toothbrush of the invention, held in the right hand of a user about to insert it in his mouth to brush the exterior surface of his right upper teeth;

FIG. 21B shows the angular relationship of the bristles of the toothbrush of FIG. 21A relative to the long axis of the teeth;

FIG. 22A shows the position of the toothbrush of the invention held in the right hand of a user about to insert it in his mouth to brush the exterior surface of his right lower teeth; and FIG. 22B shows the angular relationship of the bristles of the toothbrush of FIG. 22A relative to the long axis of the teeth.

DETAILED DESCRIPTION OF PREFERRED EMBODIMENTS

Figure 1:
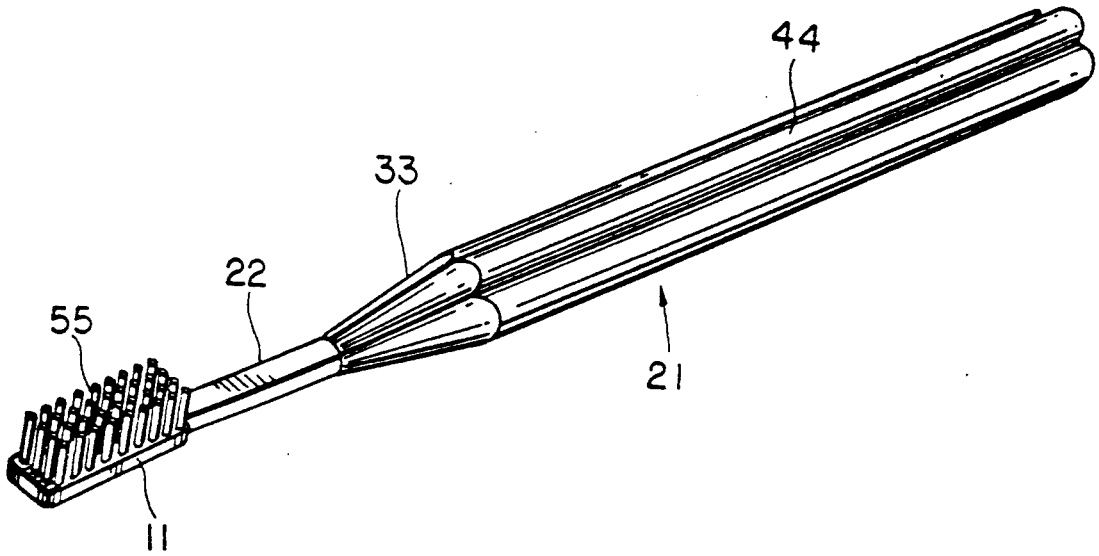
FIG. 1 is a perspective view of a first embodiment of the toothbrush of the invention.

The toothbrush of the invention efficiently cleans the teeth, the area under the sulcus and between the teeth and massages and stimulates the gums thereby providing excellent oral hygiene. This is accomplished by the toothbrush of the invention even when it is used by a person untutored in correct toothbrushing methods, since it automatically orients the brush head to the intrasulcus position of 45° to the long axis of the teeth. This position of the toothbrush is the cornerstone of the Dr. Bass and Dr. Skillman toothbrushing method which oral care professionals prescribe and which results in excellent oral hygiene. As shown in FIGS. 1 to 12, the toothbrush of the invention has a substantially longitudinally aligned handle 21, consisting of a relatively thin forward portion 22 of rectangular, circular, elliptical, or other similar cross-section, a gripping portion 44 that permits a user to grip the toothbrush in a firm detented manner between the thumb and the remainder of the fingers in curled positions, a short transition portion 33 joining the forward portion 22 to the gripping portion 44 and a brush head 11, extended from the forward portion 22 of said handle. The handle 21 thus has three or four parts or components.

Figure 15:
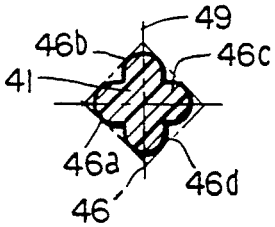
FIG. 15 is a cross-sectional view, taken along the lines XV—XV, of FIG. 3 with a circumscribing square around the section and a diagonal of the square shown.

In accordance with the invention, and as illustrated in FIGS. 1 to 12, the principal feature, improvement, advantage or novelty of the invention is the configuration of the cross-section 41 (FIGS. 5 to 9) of the gripping portion 44 of the handle 21 and the orientation, position or relationship of the bristles 55 of the brush head 11 and said gripping portion., FIG. 15 shows the cross-section 41, taken along the lines XV—XV, of FIG. 3, of the first embodiment of the gripping portion 44 of the handle 21. The cross-section 41 is circumscribed by a square 46 having four sides 46*a*, 46*b*, 46*c* and 46*d*. The square 46 has a first diagonal 49, shown in the vertical position, substantially parallel to the bristles 55 of the brush head 11, as shown in FIG. 5.

The sides 46*a* to 46*d* of the square 46 (FIG. 15) are preferably 0.500 inch wide, which is equal to, or greater than, the width of known brush heads. In an operable embodiment of the toothbrush of the invention, the dimension of the sides of the circumscribed square may be greater or less than 0.500 inch, however.

Figure 12:
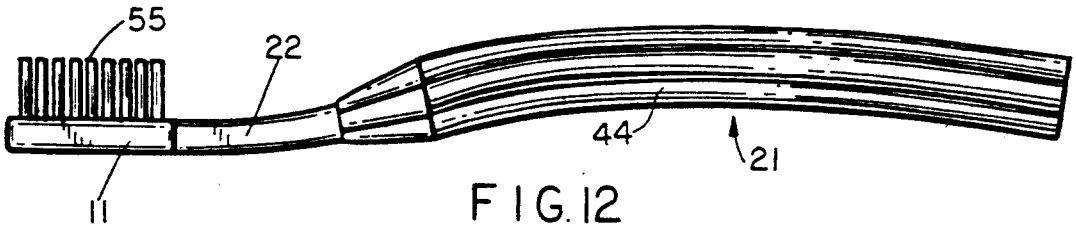
FIG. 12 is a side view of a third modification of the first, second, third, fourth and fifth embodiments of the toothbrush of the invention.

The cross-section 41 of the gripping portion 44 of the handle 21 of the second, third, fourth and fifth embodiments of the invention, shown in FIGS. 5 to 9, can be similarly circumscribed by a square 46. The first diagonal 49 of the square is substantially parallel to the bristles 55 of the brush head 11 in the second to fifth embodiments of the invention (FIGS. 5 to 9). In the modification of FIG. 12, the gripping portion 44 is curved or substantially arcuate and the diagonal 49 of the square 46 is substantially parallel to the planes of the rows of bristles of the brush head 11.

In the first embodiment of the invention, shown in FIGS. 1 to 5 and 15, the gripping portion 44 comprises four elongated substantially cylindrical stems 45 joined together to form a substantially fluted gripping portion as shown in cross-section 41 that can be circumscribed by a square 46 having a first diagonal 49. Each of the stems has a cross-section preferably 0.125 inch in radius in an operable embodiment of the toothbrush, although the actual radius of the circular cross-section may be greater or less than 0.125 inch.

In the second embodiment of the invention, shown in FIG. 6, the gripping portion 44 comprises four elongated stems 47 joined together to form a section 41 that can be circumscribed by a square 46 having a first diagonal 49. Each of the stems 47 has a substantially octagonal cross-section, so that the gripping portion 44 has planar surfaces 48.

In the third embodiment of the invention, shown in FIG. 7, each of the four longitudinal sides of the cross-section 41 has a substantially depressed surface 50 shown as being concave and the sides are joined to each other at substantially convex surfaces 52. The cross-section 41 can be circumscribed by a square 46 having a first diagonal 49. In a variation of this embodiment, the depressed surface may be of "V" configuration formed by substantially planar surfaces.

In the fourth embodiment of the invention, shown in FIG. 8, each of the four longitudinal sides of the cross-section 41 has a substantially depressed surface 50 shown as being concave and the sides are joined to each other at substantially planar joining surfaces 53. The cross-section 41 can be circumscribed by a square having a first diagonal 49. In a variation of this embodiment, the depressed surface may be "V" configuration formed by substantially planar surfaces.

In the fifth embodiment of the invention, shown in FIG. 9, each of the four longitudinal sides 54 of the cross-section 41 is substantially planar and said sides are joined to each other at substantially curved joining areas 60. The cross-section 41 can be circumscribed by a square 46 having a first diagonal 49.

Each of the five embodiments of the invention, shown in FIGS. 5 to 9, show opposing detente side pairs 42 and 42' and 45 and 45' which are the side pairs which the fingers of a user's hand automatically, unconsciously and comfortably fall into during handling of the wet and slippery gripping portion 44 of the toothbrush handle 21. Each of the embodiments has four corners which provide narrow and/or rounded gripping areas which a user's fingers will unconsciously slide off and into the detente pair position 42 and 42' or 45 and 45', in a reflex type reaction.

FIG. 10 shows a first modification of the first to fifth embodiments of the toothbrush of the invention, wherein the gripping portion 44 of the handle 21 is tapered for aesthetic reasons or to permit the toothbrush to fit into a common wall-mounted toothbrush holder.

FIG. 11 shows a second modification of the first to fifth embodiments of the toothbrush of the invention, wherein the gripping portion 44 is stepped for aesthetic reasons or to permit the toothbrush to fit into a common wall-mounted toothbrush holder.

FIG. 12 illustrates a third modification of the first to fifth embodiments of the toothbrush of the invention, where the gripping portion 44 of the handle 21 is curved for aesthetic reasons. The plane containing the curvature is parallel to a plane containing a row of bristles in the brush head 11.

Figure 13:
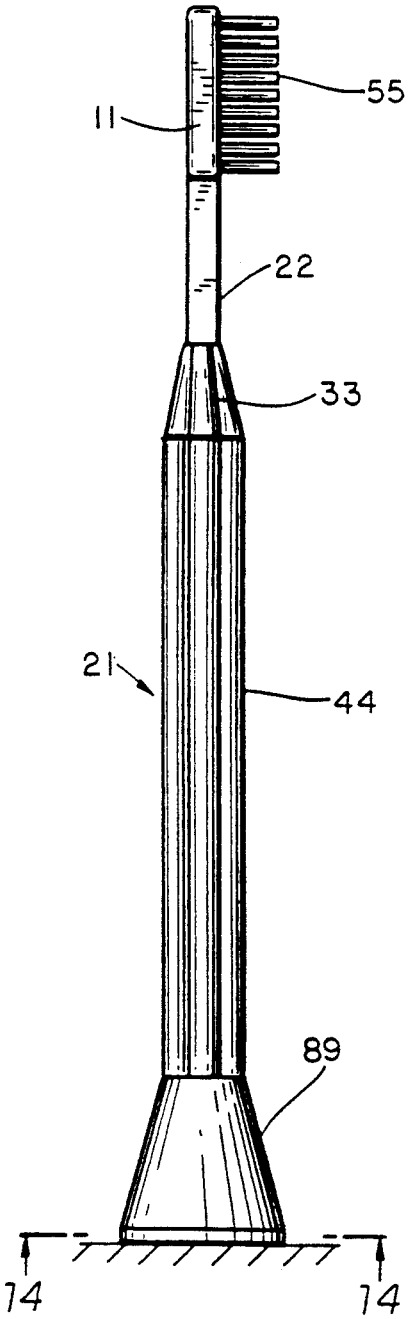
FIG. 13 is a side view of a fourth modification of the first, second, third, fourth and fifth embodiments of the toothbrush of the invention.
Figure 14:
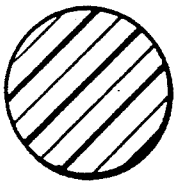
FIG. 14 is a cross-sectional view, taken along the lines XIV—XIV, of FIG. 13.

FIG. 13 depicts a fourth modification of the first to fifth embodiments of the toothbrush of the invention, wherein a base 89, having a circular cross-sectional bottom, as shown in FIG. 14, is an integral part of the gripping portion 44 of the handle 21. The juncture of the base 89 with the gripping portion 44 of the handle 21 may be of a different cross-section than that of said gripping portion, or may be faired smoothly into the cross-section of said gripping portion. In a preferred embodiment, the bottom diameter of the base 89 of FIG. 13, as shown in FIG. 14, is 1.00 inch. The purpose of adding the base 89 to the end of the gripping portion 44 of the handle 21 is to provide a larger, weighted end to permit the toothbrush to stand upright, and be stable, vertically, to permit storage in this position in a bathroom cabinet, or on a shelf or vanity. FIG. 13 shows the toothbrush of the invention standing upright in position. In an operable embodiment of the toothbrush, the diameter of the base 89 may be greater or less than 1.00 inch, and its cross-sectional configuration may be other than circular; such as, for example, square, oval, rectangular, irregular, or other.

Figure 16:
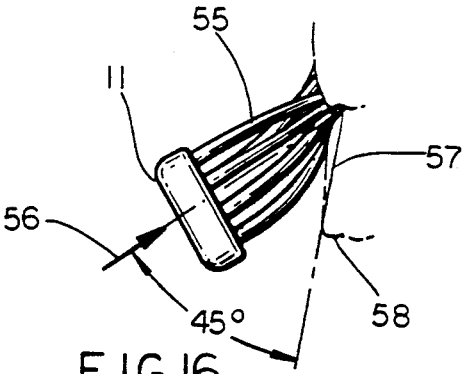
FIG. 16 is an end view of the toothbrush of the invention, on an enlarged scale, showing the intrasulcus position of the bristles of the brush head at a 45° angle to the long axis of the teeth of the user, as prescribed in the Dr. Bass and Dr. Skillman toothbrushing method.

FIG. 16 illustrates the 45° angle between the brush head bristle axis 56 and the long axis 57 of the teeth 58, as prescribed in the Dr. Bass and Dr. Skillman toothbrushing method as it is commonly shown in periodontal texts. The position shown is for the outer, upper teeth. An identical brush head-tooth relative angular position is prescribed for the outer surfaces of the lower teeth and for the inner surfaces of the teeth, both upper and lower.

FIGS. 17A, 17B, 18A, 18B, 19A, 19B, 20A, 20B, 21A, 21B, 22A, and 22B are provided to compare the toothbrush of the invention and a known, essentially flat-handled toothbrush with regard to the orientation of the brush head as it is held by a user, in front of the mouth preparatory to inserting the brush head into the mouth for toothbrushing. The hand position shown is the normal, articulated position that would be used by a human in assuming the initial stance at the start of the toothbrushing procedure.

FIG. 17A shows a known flat-handled toothbrush held in the right hand 61 as it is about to enter the left side of a user's mouth and FIG. 20A shows a known flat-handled toothbrush held in the right hand 61 as it is about to enter the right side of a user's mouth. In both cases, as shown in FIGS. 17B and 20B, the brush head bristle axis 56 is at a substantially 90° angle with the long axis 57 of the teeth. To obtain the preferred 45° angle of brush head bristle axis of the Dr. Skillman and Dr. Bass method, the user must consciously position the hand 61 to that position by rotation of the wrist and forearm.

In contrast with the known flat-handled toothbrush, the toothbrush of the invention enters the mouth at the preferred prescribed 45° angle. FIG. 18A shows the toothbrush of the invention held in the right hand 61 of a user as it is about to enter the left side of his or her mouth. One pair of the detente gripping sides of the gripping portion 44 are grasped by the user's fingers and the brush head and bristles are angled upward.

FIG. 19A shows the toothbrush of the invention held in the right hand 61 of a user as it is about to enter the left side of his or her mouth, the other pair of the detente gripping sides of the gripping portion 44 are grasped by the fingers and the brush head and bristles are angled downward.

FIG. 21A shows the toothbrush of the invention held in the right hand 61 of a user as it is about to enter the right side of his or her mouth. One pair of the gripping sides of the gripping portion 44 are grasped by the user's fingers and the brush head and bristles are angled upward.

FIG. 22A shows the toothbrush of the invention held in the right hand 61 of a user as it is about to enter the right side of his or her mouth. The other pair of the detente gripping sides of the gripping portion 44 are grasped by the fingers and the brush head and bristles are angled downward.

FIGS. 18B, 19B, 21B and 22B show that in use, the toothbrush of the invention, as illustrated in FIGS. 18A, 19A, 21A and 22A, the angle formed between the brush head, bristle axis 56 and the long axis 57 of the teeth is 45°; the prescribed and preferred angle of the Dr. Skillman and Dr. Bass toothbrushing method. As shown in FIGS. 18A, 18B, 19A, 19B, 21A, 21B, 22A and 22B, the prescribed toothbrush angle inclination is achieved without conscious thought, hand 61, forearm or wrist rotation, or effort of the user.

To reach all the outside and inside tooth surfaces of the mouth, the user would rotate the toothbrush of the invention 180° relative to the positions shown in FIGS. 18A, 19A, 21A and 22A and would place his or her thumb on the detente surface opposite those shown in said FIGS.

Although the illustrated use of the toothbrush of the invention is with the right hand of the user, the left hand may be used with the same effect.

Although shown and described in what is believed to be the most practical and preferred embodiment, it is apparent that departures from the specific method and design described and shown will suggest themselves to those skilled in the art and may be made without departing from the spirit and scope of the invention. I, therefore, do not wish to restrict myself to the particular construction described and illustrated, but desire to avail myself of all modifications that may fall within the scope of the appended claims.

I claim:

1. A method of brushing teeth comprising:

providing a toothbrush having a substantially longitudinally aligned handle with spaced opposite ends, brush head means at one end of said handle having a plurality of bristles extending therefrom; and a gripping portion at the opposite end of said handle, said gripping portion being in the form of a substantially four-sided column having a cross-section with a shape which can be circumscribed with a square, the geometrical relationship of the cross-section of said gripping portion and said brush head means being such that one diagonal of the circumscribing square is substantially parallel to the bristles of said brush head and the other diagonal of said square is substantially perpendicular to said bristles of said brush head, the four sides of the column of said gripping portion having four longitudinal sides forming two pairs of detente gripping positions for being respectively engaged by a hand of a user, said detente gripping positions of one pair being substantially perpendicular to the detente gripping positions of the other pair, said gripping portion of said handle having a cross-section substantially along its entire length with a circumference formed by corner sections forming at said detente gripping positions a configuration to automatically guide the thumb and fingers of the user into gripping engagement on the handle in a position so that when the handle is moved longitudinally along the gum line of the teeth, the bristles will be at an angle of 45° relative to the long axis of the teeth without rotation of the hand, wrist or forearm of the user, engaging the thumb and at least one finger of the user with one pair of said detente gripping positions of said gripping portion of said handle, and longitudinally displacing the handle back and forth along the gum line of the teeth of the user while maintaining the thumb and finger of the user in engagement with said detente gripping positions to maintain the attitude of the bristles fixed relative to the teeth at said angle of 45° so that the bristles will always contact and brush the teeth at said angle of 45° during the longitudinal back and forth movements of the handle.

2. A method as claimed in claim 1, wherein during said longitudinal displacing of the handle, maintaining said hand, wrist and forearm of the user in normal, unrotated state.

3. A method as claimed in claim 1, comprising reversing the detente gripping positions engaged by the thumb and said finger of the user for brushing different tooth surfaces of upper and lower teeth and left and right jaws with the bristles always at said angle of 45° relative to the long axis of the teeth.

* * * * *